US009243339B2

(12) United States Patent
Pearson

(10) Patent No.: US 9,243,339 B2
(45) Date of Patent: Jan. 26, 2016

(54) ADDITIVES FOR PRODUCING COPPER ELECTRODEPOSITS HAVING LOW OXYGEN CONTENT

(76) Inventor: Trevor Pearson, Cradley Heath (GB)

( * ) Notice: Subject to any disclaimer, the term of this patent is extended or adjusted under 35 U.S.C. 154(b) by 448 days.

(21) Appl. No.: 13/480,887

(22) Filed: May 25, 2012

(65) Prior Publication Data

US 2013/0313119 A1 Nov. 28, 2013

(51) Int. Cl.

| | |
|---|---|
| ***C25D 3/38*** | (2006.01) |
| ***C25D 3/40*** | (2006.01) |
| ***C25D 21/04*** | (2006.01) |
| ***C25D 1/04*** | (2006.01) |

(52) U.S. Cl.

CPC .. *C25D 1/04* (2013.01); *C25D 3/38* (2013.01); *C25D 3/40* (2013.01); *C25D 21/04* (2013.01)

(58) Field of Classification Search

CPC ..... C25D 21/04; C25D 3/34; C25D 3/40
USPC ..... 205/296, 297, 298
See application file for complete search history.

(56) References Cited

U.S. PATENT DOCUMENTS

| | | | | |
|---|---|---|---|---|
| 3,030,283 | A * | 4/1962 | Strauss et al. | 205/296 |
| 3,616,330 | A | 10/1971 | Denchfield et al. | |
| 3,730,853 | A | 5/1973 | Sedlacek et al. | |
| 3,770,598 | A | 11/1973 | Creutz | |
| 3,778,357 | A | 12/1973 | Dahms et al. | |
| 4,009,087 | A | 2/1977 | Kardos et al. | |
| 4,036,710 | A | 7/1977 | Kardos et al. | |
| 4,036,711 | A * | 7/1977 | Kardos et al. | 205/296 |
| 4,374,709 | A | 2/1983 | Combs | |
| 4,376,685 | A * | 3/1983 | Watson | 205/298 |
| 4,425,197 | A * | 1/1984 | Inoue | 205/70 |
| 4,469,564 | A | 9/1984 | Okinaka et al. | |
| 4,555,315 | A | 11/1985 | Barbieri et al. | |
| 4,673,469 | A | 6/1987 | Beach et al. | |
| 4,673,472 | A | 6/1987 | Morrissey et al. | |
| 4,686,017 | A * | 8/1987 | Young | 205/234 |
| 5,024,733 | A | 6/1991 | Abys et al. | |
| 5,167,791 | A * | 12/1992 | Herbert et al. | 205/67 |
| 6,444,110 | B2 | 9/2002 | Barstad et al. | |
| 6,605,204 | B1 | 8/2003 | Martyak et al. | |
| 6,679,983 | B2 | 1/2004 | Morrissey et al. | |
| 6,706,418 | B2 | 3/2004 | Egli et al. | |
| 7,074,315 | B2 | 7/2006 | Desmaison et al. | |
| 7,815,786 | B2 | 10/2010 | Paneccasio, Jr. et al. | |
| 7,968,455 | B2 | 6/2011 | Lin et al. | |
| 2003/0019759 | A1 | 1/2003 | Shindo et al. | |
| 2011/0171491 | A1 | 7/2011 | Suzuki et al. | |

FOREIGN PATENT DOCUMENTS

| | | |
|---|---|---|
| GB | 790870 | 2/1958 |
| GB | 1 202 992 | 8/1970 |
| GB | 2 141 141 | 12/1984 |
| WO | 01/12880 | 2/2001 |

* cited by examiner

*Primary Examiner* — Luan Van
*Assistant Examiner* — Louis Rufo
(74) *Attorney, Agent, or Firm* — Carmody Torrance Sandak & Hennessey LLP

(57) ABSTRACT

A copper electroplating bath for producing copper electrodeposits is described. The copper electroplating bath comprises (a) a soluble copper salt, (b) an electrolyte comprising one or more acids, and (c) a grain refining additive comprising an alkyl, aryl or alkylaryl diamine. The copper electroplating bath can be used for producing electroformed copper deposits having low oxygen content.

29 Claims, No Drawings

ADDITIVES FOR PRODUCING COPPER ELECTRODEPOSITS HAVING LOW OXYGEN CONTENT

FIELD OF THE INVENTION

The present invention relates generally to electroplating baths for producing electroformed copper deposits having low oxygen content.

BACKGROUND OF THE INVENTION

Electroplating substrates with copper is generally well known in the art. Electroplating methods involve passing a current between two electrodes in a plating solution where one electrode is the article to be plated. A common plating solution is an acid copper plating solution comprising (1) a dissolved copper salt (such as copper sulfate), (2) an acidic electrolyte (such as sulfuric acid) in an amount sufficient to impart conductivity to the bath, and (3) various additives such as surfactants, brighteners, levelers and suppressants, to enhance the effectiveness of the bath.

"Electroforming" refers to the process of electrodepositing a metal (such as copper) on a mandrel to produce an independent, mechanically viable, metal object that can stand alone when separated from the mandrel. Various metals can be electroformed, including, for example, copper, nickel, iron and various alloys thereof. The metal is electrodeposited on the mandrel to a desired thickness and the mandrel is then removed to separate the electroformed component from the mandrel.

Although the bath chemistry employed in electroforming is very similar to that of electroplating chemistry, the equipment and process requirements can differ considerably. While electrodeposits are used to enhance the surface properties of a substrate metal or nonconductor, electroforms are typically used as independent objects and are typically separated from the substrate mandrel after electrodeposition. Although good adhesion is a necessity in electroplating applications, separability of the electroform from the substrate mandrel is also essential for success in electroforming, and mechanical or metallurgical bonding of an electroform to its substrate mandrel would negate the purpose of the process.

Electroforming enables a user to manufacture complex shapes and surfaces at low unit cost and offers the ability to make shapes that would otherwise be impossible or impractical to mold in metal. Electroforming involves applying a coating to a three-dimensional shape, which enables items with very complex internal shapes, such as tubing manifolds, bellows, and mold recesses to be electroformed onto a machined or fabricated mandrel. Seamless objects, as well as complex shapes, which economically defy machining, can be repeatedly formed by electroforming. In addition, the nearly perfect surface reproducibility resulting from the electroforming process makes the process ideal for dimensionally exacting applications, including for example lens mold production, rotogravure printing plates, holographic embossing plates, and optimal memory disc mold cavities, among others.

An electroforming "mandrel" is the substrate or shape or form that the new electroform will take in the process. Mandrels are designed to be separated from the electroform and to be used again in the production process, and are typically made of a durable metal such as nickel, stainless steel or brass.

One application of electroformed copper is in the fabrication of copper cylinders, in which copper is plated onto a rotating stainless steel or other suitable cylindrical mandrel in a layer that is thick enough to be self-supporting and is then separated from the mandrel in order to form a finished cylinder.

There are several possible electrolytes for the production of copper electroforms including, cyanide copper, pyrophosphate copper and acid copper electrolytes such as sulfate and fluoroborate copper electrolytes. Most commonly, acid copper electrolytes are preferred and the copper sulfate/sulfuric acid electrolyte is the most widely used.

In order to produce electroforms of a suitable thickness, it is necessary to include additives in the plating electrolyte in order to prevent deposit nodulation, which would cause a deterioration in the mechanical properties of the electrodeposited copper. In the case of sulfate and fluoroborate electrolytes, the additives have typically included a combination of sulfopropyl sulfides and polyether molecules in the presence of chloride ions as described for example in U.S. Pat. No. 4,009,087 to Kardos et al. and in U.S. Pat. No. 3,778,357 to Dahms et al., the subject matter of each of which is herein incorporated by reference in its entirety. In addition other compounds may also be added as "leveling" agents to give copper deposits plated from the electrolyte scratch-hiding properties.

The inventors have discovered that oxygen in copper adversely affects copper's inherent high ductility, high electrical and thermal conductivity, resistance to deterioration when heating under reducing conditions, high impact strength, strong adherence of oxide scale, creep resistance, weldability and low volatility under high vacuum. In addition, there are applications for copper electroforms in which some welding of the fabrication is required. In this instance, the oxygen content of the copper electroforms must be low, typically below 10 ppm. However, copper electroforms produced on rotating cylinder mandrels often have high oxygen contents (up to about 500 ppm of oxygen).

The inventors believe that oxygen is incorporated into the deposit via two separate mechanisms. Firstly, the copper solution contains dissolved oxygen and the rotating cylindrical mandrel is often only partially immersed in the plating electrolyte. Thus, gaseous oxygen is in contact with the cylinder and may be subject to electrochemical reduction to form cuprous oxide, which is likely co-deposited at grain boundaries in the growing electroform according to the following reactions:

$$2Cu^{2+}+2e^{-}\rightarrow 2Cu^{+}$$

$$2Cu^{+}+\tfrac{1}{2}O_2+2e^{-}\rightarrow Cu_2O$$

The other mechanism by which oxygen can be incorporated into the deposit is by the incorporation of oxygen containing additives into the deposit. Additives modify the structure of the deposited copper by a mechanism of adsorption at growth sites, so some degree of incorporation of oxygen from the additives is inevitable.

Attempts have been made over the years to reduce the oxygen level in copper deposits. One prior art method of reducing the oxygen content of copper uses a remelting step under a controlled reducing atmosphere to produce a low-oxygen copper. This process has the disadvantage of being difficult to control. Another process involves deoxidizing molten electrically refined copper by the addition of a reducing material such as phosphorus, boron or lithium, producing the oxides of the metal and a low-oxygen copper. This process has the disadvantage of leaving dissolved reducing metal in the copper, which can adversely affect the properties of the copper. Another process involves the electroforming of low-oxygen copper from a mineral acid bath containing a wood such as Alleghany White Oak. This process has the disadvantage of being operable only at low current densities. Still another process involves the addition of a pentose, such as xylose, arabinose, ribose or lyxose to the plating bath, as described for example in U.S. Pat. No. 3,616,330 to Denchfield, the subject matter of which is herein incorporated by reference in its entirety.

However, there remains a need in the art for grain refining additives for copper plating baths which do not contain significant amounts of oxygen and for improved copper plating baths that are capable of producing electroformed copper deposits having low oxygen content.

SUMMARY OF THE INVENTION

It is an object of the present invention to provide a copper electroplating bath capable of producing electroformed copper deposits.

It is another object of the present invention to provide a copper electroplating bath capable of producing electroformed copper deposits having low oxygen content.

It is still another object of the present invention to provide a copper electroplating bath containing gain refining additives which do not contain significant amounts of oxygen.

To that end, in one embodiment the present invention relates generally to a copper electroplating bath for producing copper electrodeposits, the copper electroplating bath comprising:

a) a soluble copper salt;

b) an electrolyte comprising one or more acids; and c) a grain refining additive comprising an alkyl, aryl or alkylaryl diamine.

In another embodiment, the present invention relates generally to a method of producing a copper electroform, the method comprising the steps of:

a) electrodepositing copper from an acidic copper electroplating bath onto a mandrel, wherein the acidic copper electroplating bath comprises:

i) a soluble copper salt;

ii) an electrolyte comprising one or more acids; and iii) a grain refining additive comprising an alkyl, aryl or alkylaryl diamine; and b) separating the electrodeposited copper from the mandrel.

DETAILED DESCRIPTION OF THE PREFERRED EMBODIMENTS

The present invention relates generally to a copper electroplating bath for producing copper electrodeposits, the copper electroplating bath comprising:

a) a soluble copper salt;

b) an electrolyte comprising one or more acids; and c) a grain refining additive comprising an alkyl, aryl or alkylaryl diamine.

Electroplating solutions in accordance with the present invention generally include at least one soluble copper salt and an acidic electrolyte. The electroplating solutions also include one or more additives, such as halides, accelerators or brighteners, suppressors, levelers, grain refiners, wetting agents, surfactants and the like.

In a preferred embodiment, the soluble copper salt is selected from the group consisting of copper sulfate, copper fluoroborate and copper sulfamate. In one embodiment, the soluble copper salt comprises copper sulfate. In addition, the one or more acids may be selected from the group consisting of sulfuric acid, fluoroboric acid, phosphoric acid, nitric acid, sulfamic acid and combinations of one or more of the foregoing. In one embodiment, the one or more acids comprise sulfuric acid.

More particularly, the aqueous acidic electrolyte may be of the sulfate type, typically comprising about 180 to about 250 g/L copper sulfate and about 30 to about 80 g/L of sulfuric acid. Alternatively the aqueous acidic electrolyte may be a fluoroborate bath, typically containing about 200 to about 600 g/L copper fluoroborate and up to about 60 g/L fluoroboric acid. Copper nitrate and copper sulfamate salts may also be used in approximately equivalent proportions for copper sulfate and the electrolyte can be acidified using equivalent amounts of phosphoric acid, nitric acid, sulfamic acid, or sulfuric acid. The copper plating bath may also contain amounts of other alloying elements, such as tin or zinc, by way of example and not limitation. Thus, the copper electroplating bath may deposit copper or copper alloy.

The inventors of the present invention have discovered that the use of alkyl, aryl or alkylaryl diamines in the plating bath can replace the function of the polyether molecules typically used as additives in the acid copper plating electrolytes, thus significantly reducing the oxygen content of the plated deposit. These additives act synergistically with sulfopropyl sulfides in a similar manner as polyether molecules and can also be used in combination with leveling additives. In addition, engineering techniques to de-aerate the electrolyte and maintain a nitrogen (or other inert gas) atmosphere above the plating bath may also be used. These additives can be used to produce fine-grained bright copper electroforms having a low oxygen content.

The additives of the present invention preferably comprise alkyl, aryl, and alkylaryl diamines having the one of the following structures:

$$R_1\text{-}R_2\text{—}N\text{—}R_3\text{—}N\text{—}R_4\text{-}R_5 \quad (1)$$

wherein $R_1$, $R_2$, $R_4$ and $R_5$ are hydrogen or $C_1$-$C_4$ alkyl and $R_3$ is $C_4$-$C_{14}$ alkyl. In a preferred embodiment, $R_1$, $R_2$, $R_4$ and $R_5$ are hydrogen and $R_3$ is $C_{10}$-$C_{14}$ alkyl.

$$R1\text{-}R2\text{—}N\text{—}R3\text{-}R4\text{-}R5\text{—}N\text{—}R6\text{-}R7 \quad (2)$$

wherein $R_1$, $R_2$, $R_4$, $R_6$ and $R_7$ are hydrogen or $C_1$-$C_4$ alkyl, and $R_3$ and $R_5$ are either aryl, cyclohexyl, substituted aryl, or substituted cyclohexyl groups.

In one embodiment, preferred examples of the additive of the invention have one of the following structures:

(a) 4,4-diamino-2,2-dimethylbicyclohexylmethane having the structure:

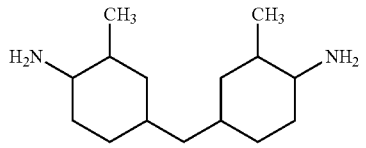

(b) 4,4-diaminodiphenylmethane having the structure:

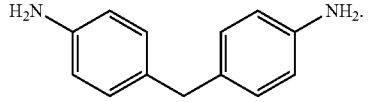

These additives may be used in copper plating bath at concentrations between about 10 ppm and 10 g/l, more preferably in the range of about 100 to about 1000 ppm. The additives described herein are particularly effective when used in combination with brighteners (or accelerators) in the copper plating bath.

Typical brighteners contain one or more sulfur atoms and have a molecular weight of about 1000 or less. Brightener compounds that have sulfide and/or sulfonic acid groups are generally preferred. In one embodiment, it has been found that sulfoalkyl sulfones of the following structures are particularly effective:

(3) $XSO_3$—$R_1$—S—S—$R_1$—$SO_3X$, wherein X is either a hydrogen ion or an alkali metal ion and $R_1$ is a $C_3$ alkyl, $C_2$ alkyl or a $CH_2CHOH$ moiety.

(4) $XSO_3$—$R_1$—SH, wherein X is either a hydrogen ion or an alkali metal ion and $R_1$ is $C_3$ alkyl, $C_2$ alkyl or a $CH_2CHOH$ moiety.

(5) $R_1$—$R_2$—N—$CS_2$—$R_3$—$SO_3X$, wherein X is either a hydrogen ion or an alkali metal ion and $R_1$ and $R_2$ are $C_1$-$C_2$ alkyl groups and $R_3$ is $C_3$ alkyl, $C_2$ alkyl or a $CH_2CHOH$ moiety.

Additives from these groups are typically used in concentrations between about 1 and about 40 ppm in combination with the additives described above. Examples of these compounds include n,n-dimethyl-dithiocarbamic acid-(3-sulfopropyl)ester, 3-mercapto-propylsulfonic acid-(3-sulfopropyl)ester, 3-mercaptopropylsulfonic acid (sodium salt), carbonic acid-dithio-o-ethylester-s-ester with 3-mercapto-1-propane sulfonic acid (potassium salt), bissulfopropyl disulfide, 3-(benzthiazolyl-s-thio)propyl sulfonic acid (sodium salt), pyridinium propyl sulfobetaine, 1-sodium-3-mercaptopropane-1-sulfonate, sulfoalkyl sulfide compounds described in U.S. Pat. No. 3,778,357, the subject matter of which is herein incorporated by reference in its entirety, the peroxide oxidation product of a dialkyl amino-thiox-methyl-thioalkanesulfonic acid, and combinations of one or more of the foregoing. Additional brighteners are described in U.S. Pat. Nos. 3,770,598, 4,374,709, 4,376,685, 4,555,315, and 4,673,469, the subject matter of each of which is herein incorporated in its entirety.

Other additives may also be used in the composition of the present invention for grain refinement, suppression of dendritic growth and improving covering and throwing power. A large variety of additives may be used to provide desired surface finishes for the copper deposit, including accelerators, suppressors, and levelers. In addition, it is possible to use the additives described herein in combination with leveling agents. Various leveling agents may be used including, for example, substituted thiourea derivatives, phenazine dyes, polymeric phenazine dyes and phenosafranine dyes, by way of example and not limitation.

In addition, one or more halides may be added to the acidic plating bath to enhance the function of the other bath additives. Chloride and bromide are preferred halides, with chloride being most preferred. If use the concentration of halide ions is preferably in the range of about 1 to about 100 ppm, more preferably, about 10 to about 50 ppm. The halide may be added as the corresponding hydrogen halide acid or as a suitable salt.

The present invention also relates generally to a method of producing a copper electroform, the method comprising the steps of:

a) electrodepositing copper from an acidic copper electroplating bath onto a mandrel, wherein the acidic copper electroplating bath comprises:

i) a soluble copper salt;

ii) an electrolyte comprising one or more acids; and iii) a grain refining additive comprising an alkyl, aryl or alkylaryl diamine; and b) separating the electrodeposited copper from the mandrel.

The electrolyte compositions of the invention and plating baths produced therefrom are typically acidic, having a pH of less than 7. If a composition of a particular pH is desired, appropriate adjustment of the pH can be made by addition of a base or by using lesser amounts of the acidic electrolytes.

Plating baths in accordance with the present invention are preferably employed at or above room temperature. In a preferred embodiment, the plating bath is maintained at a temperature of between about room temperature and about 150° F.

Plating is preferably conducted at a current ranging from 10 to 500 ASF, depending upon the particular plating method being used and characteristics of the substrate mandrel. Plating time may range from about 5 minutes to a few days or more, depending on the complexity of the workpiece and the desired thickness of the copper deposit.

For symmetrical mandrels, the uniformity of the electroforming thickness can be enhanced by rotating the mandrel (cathode) in the bath, which has the effect of continuously reorienting the cathode with respect to the anode, thereby eliminating current density effects in one direction. In addition, the plating bath may be agitated to enhance high speed deposition, such as by air sparger, work piece agitation, impingement or other suitable method.

COMPARATIVE EXAMPLE 1

An experimental scale rotogravure cell (20 liter sump) was used to produce 100 micron thickness copper foils on a stainless steel cylindrical mandrel. An immersion depth of the cylinder of 33% and a rotation speed equivalent to a linear velocity of 75 m/min using a current density of 6 A/dm$^2$ average (actual plating current density of 18 A/dm$^2$ on the immersed area) for 90 minutes was used for the experiment. A foil was plated using 20 ppm of Raschig SPS (a sulfopropyl sulfide of structure 3 above, where $R_1$ was $C_3$ and X was sodium) and 100 ppm of polyethylene glycol/polypropylene glycol random copolymer (50% PEG-MW approximately 50,000) in an electrolyte comprising 200 g/L copper sulfate and 60 g/L sulfuric acid. The oxygen content of the resulting foil was analyzed by glow discharge techniques and was determined to be 124 ppm.

Example 1

A foil was plated using the same experimental setup as with Comparative Example 1, but the electrolyte contained 500 ppm of 4,4-diamino-2,2-dimethylbicyclohexylmethane (corresponding to structure 1 above) instead of the polyether molecule used in Comparative Example 1. In this case, the oxygen content of the deposit was analyzed and found to be 78 ppm, which is nearly 50% less than the oxygen content present in the deposit of Comparative Example 1.

When using the additives described herein in combination with techniques to exclude oxygen from the plating cell, it is possible to produce copper deposits having very low oxygen content. As discussed above, techniques to exclude oxygen from the plating cell include de-aerating the electrolyte and maintaining an inert gas atmosphere above the plating may be used. Thus the use of the additives described herein, alone or in combination with techniques to exclude oxygen from the plating cell produces copper deposits having an oxygen content of less than about 80 ppm, more preferably less than about 50 ppm, and most preferably less than about 10 ppm.

What is claimed is:

1. A copper electroplating bath for producing copper electrodeposits, the copper electroplating bath comprising:

a) a soluble copper salt;

b) an electrolyte comprising one or more acids; and c) a grain refining additive comprising an alkyl diamine, wherein the alkyl diamine has the structure:

$$R_1\text{-}R_2\text{—}N\text{—}R_3\text{—}N\text{—}R_4\text{-}R_5, \quad (1)$$

wherein $R_1$, $R_2$, $R_4$, and $R_5$ are hydrogen or $C_1$-$C_4$ alkyl and $R_3$ is $C_{10}$-$C_{14}$ alkyl; and d) a brightener compound comprising a sulfoalkyl sulfone, wherein the sulfoalkyl sulfone compound is present in the electrolyte at a concentration of between about 1 ppm and about 40 ppm.

2. The copper electroplating bath according to claim 1, wherein the soluble copper salt is selected from the group consisting of copper sulfate, copper fluoroborate, and copper sulfamate.

3. The copper electroplating bath according to claim 2, wherein the soluble copper salt comprises copper sulfate.

4. The copper electroplating bath according to claim 1, wherein the one or more acids are selected from the group consisting of sulfuric acid, fluoroboric acid, phosphoric acid, nitric acid, sulfamic acid and combinations of one or more of the foregoing.

5. The copper electroplating bath according to claim 4, wherein the one or more acids comprise sulfuric acid.

6. The copper electroplating bath according to claim 1, wherein the diamine comprises 4,4-diamino-2,2-dimethylbicyclohexylmethane.

7. The copper electroplating bath according to claim 1, wherein the concentration of the diamine in the electroplating bath is between about 10 ppm and about 10 g/L.

8. The copper electroplating bath according to claim 7, wherein the concentration of the diamine in the electroplating bath is between about 100 ppm and about 1000 ppm.

9. The copper electroplating bath according to claim 1, wherein the brightener is selected from the group consisting of n,n-dimethyl-dithiocarbamic acid-(3-sulfopropyl)ester, 3-mercapto-propylsulfonic acid-(3-sulfopropyl)ester, 3-mercapto-propylsulfonic acid (sodium salt), carbonic acid-dithio-o-ethylester-s-ester with 3-mercapto-1-propane sulfonic acid (potassium salt), bissulfopropyl disulfide; 3-(benzthiazolyl-s-thio)propyl sulfonic acid (sodium salt), pyridinium propyl sulfobetaine, 1-sodium-3-mercaptopropane-1-sulfonate, the peroxide oxidation product of a dialkyl amino-thiox-methyl-thioalkanesulfonic acid, and combinations of one or more of the foregoing.

10. The copper electroplating bath according to claim 1, comprising a leveling agent.

11. The copper electroplating bath according to claim 1, wherein the diamine has the structure:

$$R_1\text{-}R_2\text{—}N\text{—}R_3\text{—}N\text{—}R_4\text{-}R_5 \quad (1)$$

wherein $R_1$, $R_2$, $R_4$, and $R_5$ are hydrogen.

12. A method of producing a copper electrofonn having a reduced oxygen content, the method comprising the steps of:

a) electrodepositing copper from an acidic copper electroplating bath onto a mandrel, wherein the acidic copper electroplating bath comprises:

i) a soluble copper salt;

ii) an electrolyte comprising one or more acids; and iii) a grain refining additive comprising an alkyl diamine, wherein the alkyl diamine has the structure:

$$R_1\text{-}R_2\text{—}N\text{—}R_3\text{—}N\text{—}R_4\text{-}R_5, \quad (1)$$

wherein $R_1$, $R_2$, $R_4$, and $R_5$ are hydrogen or $C_1$-$C_4$ alkyl and $R_3$ is $C_{10}$-$C_{14}$ alkyl; and iv) a brightener compound comprising a sulfoalkyl sulfone, wherein the sulfoalkyl sulfone compound is present in the electrolyte at a concentration of between about 1 ppm and about 40 ppm; and separating the electrodeposited copper from the mandrel.

13. The method according to claim 12, wherein the soluble copper salt is selected from the group consisting of copper sulfate, copper fluoroborate and copper sulfamate.

14. The method according to claim 13, wherein the soluble copper salt comprises copper sulfate.

15. The method according to claim 12, wherein the one or more acids are selected from the group consisting of sulfuric acid, fluoroboric acid, phosphoric acid, nitric acid, sulfamic acid and combinations of one or more of the foregoing.

16. The method according to 15, wherein the one or more acids comprise sulfuric acid.

17. The method according to claim 12, wherein the diamine comprises 4,4-diamino-2,2-dimethylbicyclohexylmethane.

18. The method according to claim 12, wherein the concentration of the diamine in the electroplating bath is between about 10 ppm and about 10 g/L.

19. The method according to claim 12, wherein the brightener is selected from the group consisting of n,n-dimethyl-dithiocarbamic acid-(3-sulfopropyl)ester, 3-mercapto-propylsulfonic acid-(3-sulfopropyl)ester, 3-mercapto-propylsulfonic acid (sodium salt), carbonic acid-dithio-o-ethylester-s-ester with 3-mercapto-l-propane sulfonic acid (potassium salt), bissulfopropyl disulfide; 3-(benzthiazolyl-s-thio)propyl sulfonic acid (sodium salt), pyridinium propyl sulfobetaine, 1-sodium-3-mercaptopropane-1-sulfonate, the peroxide oxidation product of a dialkyl amino-thiox-methyl-thioalkanesulfonic acid, and combinations of one or more of the foregoing.

20. The method according to claim 12, wherein the oxygen content of the deposit is less than about 80 ppm.

21. The method according to claim 20, wherein the oxygen content of the deposit is less than about 50 ppm.

22. The method according to claim 21, wherein the oxygen content of the deposit is less than about 10 ppm.

23. The method according to claim 12, wherein electrodepositing copper is conducted at a current density of between about 10 and about 500 ASF.

24. The method according to claim 12, wherein the copper electroplating bath is maintained at a temperature of between about room temperature and 150° F.

25. The method according to claim 12, wherein the copper electroplating bath is agitated during use.

26. The method according to claim 12, wherein the mandrel is a symmetrical mandrel that rotates in the acidic copper electroplating bath.

27. The method according to claim 26 wherein the mandrel is completely submersed in the acidic copper electroplating bath.

28. The method according to claim 12, wherein the diamine has the structure:

$$R_1\text{-}R_2\text{—}N\text{—}R_3\text{—}N\text{—}R_4\text{-}R_5, \quad (1)$$

wherein $R_1$, $R_2$, $R_4$, and $R_5$ are hydrogen.

29. The method according to claim 12, wherein oxygen is excluded from the copper electroplating bath by at least one of de-aerating the copper electroplating bath and maintaining an inert gas atmosphere above the copper electroplating bath.

* * * * *